US005815973A

United States Patent [19]

Hochstrate

[11] Patent Number: 5,815,973

[45] Date of Patent: Oct. 6, 1998

[54] COMPACT PISTOL

[75] Inventor: Paul M. Hochstrate, Plantsville, Conn.

[73] Assignee: Colt's Manufacturing Company, Inc., West Hartford, Conn.

[21] Appl. No.: 745,045

[22] Filed: Nov. 7, 1996

[51] Int. Cl.[6] ..... F41A 3/00; F41C 3/14

[52] U.S. Cl. ..... 42/69.03; 42/65

[58] Field of Search ..... 42/69.03, 69.02, 42/69.01, 65; 89/147; 29/1.1, 1.11

[56] References Cited

U.S. PATENT DOCUMENTS

| | | | |
|---|---|---|---|
| Re. 7,547 | 3/1877 | Wood | 29/1.1 |
| 27,868 | 4/1860 | Newbury | 42/65 |
| 57,978 | 9/1866 | Schenck | 42/69.01 |
| 456,166 | 7/1891 | Shields | 42/69.01 |
| 808,214 | 12/1905 | Putnam | 42/69.01 |
| 1,004,424 | 9/1911 | Hennick | 42/69.03 |
| 1,381,590 | 6/1921 | Oliver | 42/69.03 |
| 2,530,363 | 11/1950 | Swebilius | 29/1.1 |
| 3,269,045 | 8/1966 | McGaughey | 42/65 |
| 3,337,979 | 8/1967 | Freed | 42/69.01 |
| 3,577,667 | 5/1971 | Kern et al. | 42/69.01 |
| 3,672,084 | 6/1972 | Pachmayr | 42/71 P |
| 3,682,040 | 8/1972 | Roy | 89/132 |
| 3,701,213 | 10/1972 | Lewis | 42/65 |
| 3,768,190 | 10/1973 | Ruger et al. | 42/65 |
| 4,021,955 | 5/1977 | Curtis | 42/70 F |
| 4,126,953 | 11/1978 | Casull | 42/65 |
| 4,132,024 | 1/1979 | Pachmayr et al. | 42/71 P |
| 4,306,487 | 12/1981 | Beretta | 89/148 |
| 4,555,861 | 12/1985 | Khoury | 42/70 F |
| 5,050,480 | 9/1991 | Knight, Jr. et al. | 89/147 |
| 5,166,458 | 11/1992 | Yoo | 42/69.03 |
| 5,195,226 | 3/1993 | Bornancini | 29/1.1 |
| 5,400,537 | 3/1995 | Meller et al. | 42/69.03 |
| 5,415,075 | 5/1995 | Moon | 89/163 |

OTHER PUBLICATIONS

Colt Parts & Accessories Catalog, Model 380, Government Model, Colt's Manufacturing Company Inc., pp. 10–11, Jan. 1991.

Howe, James Virgil, "The Modern Gunsmith, vol. I", New York: 1937, pp. 41–42.

*Primary Examiner*—Charles T. Jordan
*Assistant Examiner*—Theresa M. Wesson
*Attorney, Agent, or Firm*—Perman & Green, LLP

[57] ABSTRACT

A pistol with a frame, a barrel and a firing mechanism. The firing mechanism includes a pivotably mounted hammer having a first hammer member and a second hammer member stationarily interlocked in a pocket of the first hammer member. The firing mechanism also includes a trigger assembly with a trigger member and a spacer pivotably mounted to the frame in a slot of the frame. The barrel has a lug on its bottom rear end that is movably mounted to the frame by a lug pin. A rear end of the lug has a contoured shape to accommodate the top of the trigger and a front of a pull bar being moved under the barrel. A handgrip panel is mounted to a handgrip section of the frame by a single fastener. The panel and handgrip section have cooperating angled surfaces to also mount the panel to the frame.

5 Claims, 7 Drawing Sheets

COMPACT PISTOL

BACKGROUND OF THE INVENTION

1. Field of the Invention

The present invention relates to firearms and, more particularly, to a compact pistol.

2. Prior Art

U.S. Pat. No. 4,555,861 discloses a pistol with a lever mounted on a pin with a hammer. U.S. Pat. No. 4,021,955 discloses a pivotably mounted trigger and a push bar. U.S. Pat. No. 3,682,040 discloses a pistol with a pivotably mounted trigger and a pulled trigger bar. U.S. Pat. Nos. 3,672,084 and 4,132,024 disclose pistol grips.

SUMMARY OF THE INVENTION

In accordance with one embodiment of the present invention a firearm is provided having a frame, a barrel connected to the frame, and a firing mechanism connected to the frame. The firing mechanism has a hammer pivotably mounted to the frame. The improvement comprises the hammer having a first hammer member with a striking face and a second hammer member with a sear surface. The second hammer member comprises a plate that is stationarily interlocked with the first hammer member.

In accordance with another embodiment of the present invention, a firearm is provided having a frame, a barrel connected to the frame, and a firing mechanism connected to the frame. The frame includes a frame member with a hand grip section and a panel connected to the hand grip section. The improvement comprises connection of the panel to the frame member including the panel having a projection at a first end of the panel with a first angled surface and a hole at a second end of the panel with a second angled surface. The frame member has a slot with a third angled surface. The projection extends into the slot with the first and third angled surfaces contacting each other. The connection has a single fastener that extends through the hole, is fastened to the frame member, and has a head that contacts the second angled surface to push the panel relative to the frame such that the first and third angled surfaces contact each other to securely seat the first end of the panel against the frame member.

In accordance with another embodiment of the present invention a firearm is provided having a frame, a barrel connected to the frame, and a firing mechanism connected to the frame. The barrel has a bottom rear lug movably connecting the barrel to the frame. The firing mechanism includes a trigger pivotably mounted to the frame and a pull bar connected to the trigger. The improvement comprises the lug having a recess in its rear bottom end to allow a top of the trigger and a front of the pull bar to move under the barrel. The recess is contoured to substantially match a contour of the front of the pull bar and a front of the top of the trigger. The trigger is pivotably mounted to the frame under the barrel.

In accordance with another embodiment of the present invention a firearm is provided having a frame, a barrel connected to the frame, and a firing mechanism connected to the frame. The frame has a trigger guard and a slot located above the trigger guard. The firing mechanism has a trigger extending through the slot and pivotably mounted to the frame in the slot by a pivot pin. The improvement comprises the trigger having a trigger member and a spacer. The trigger member has a reduced width at the pivot pin that is less than a width of the slot such that the trigger member can be inserted through a bottom of the slot at an angle which can pass the trigger guard. The spacer is located next to the trigger member in the slot and connected to the frame by the pivot pin such that the trigger member and the spacer extend across the width of the slot to stably, pivotably mount the trigger member on the pivot pin in the slot.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
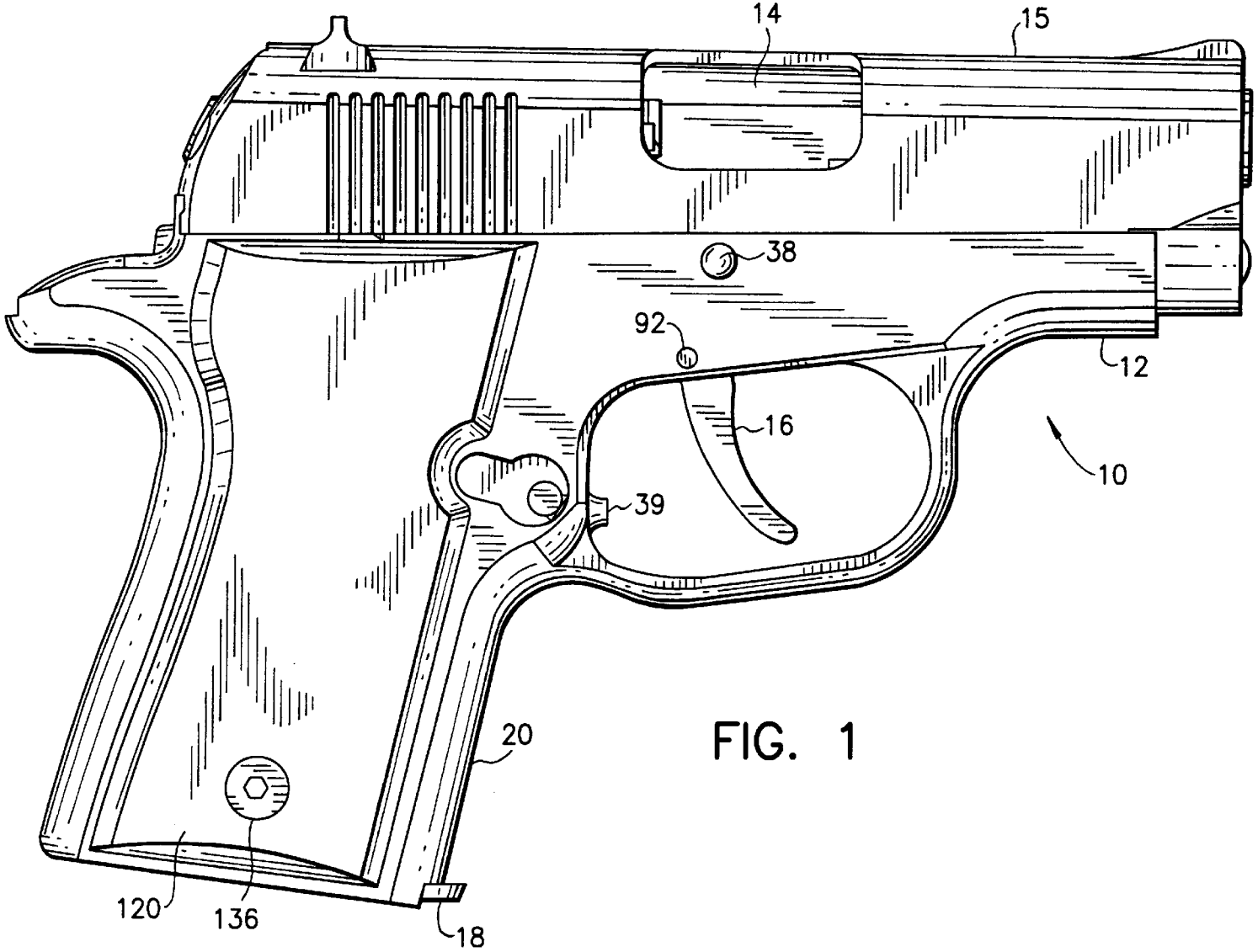
FIG. 1 is an elevation right side view of a pistol incorporating features of the present invention.

Referring to FIG. 1, there is shown an elevation right side view of a firearm 10 incorporating features of the present invention. Although the present invention will be described with the reference to the single embodiment shown in the drawings, it should be understood that the present invention can be embodied in various different types and kinds of alternate embodiments and different types and kinds of firearms. In addition, any suitable size, shape or type of elements or materials could be used.

Figure 2:
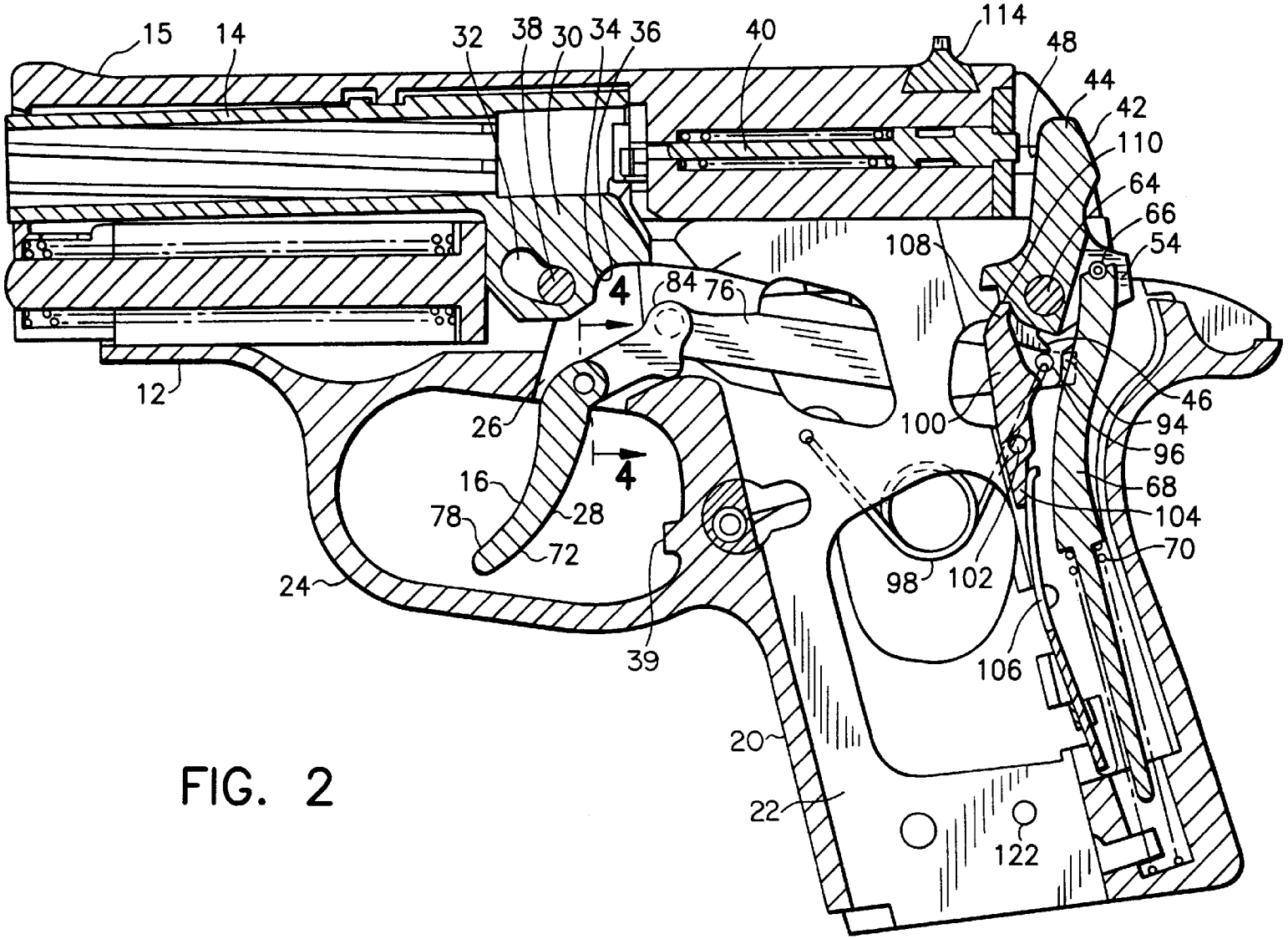
FIG. 2 is a cross-sectional view of the pistol shown in FIG. 1.
Figure 2A:
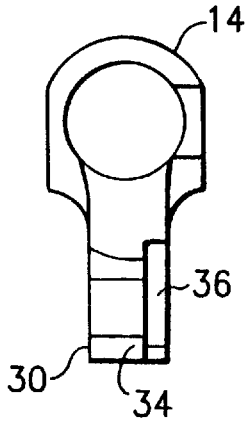
FIG. 2*a* is an elevational rear view of the barrel shown in FIG. 2.
Figure 2B:
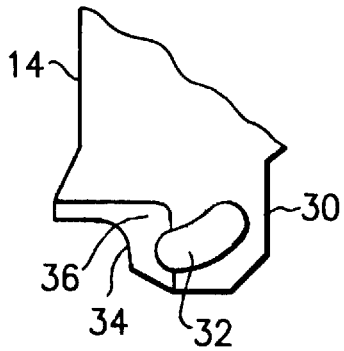
FIG. 2*b* is a partial elevational right side view of the rear of the barrel shown in FIG. 2*a;*

The firearm 10 is a semi-automatic pistol. The pistol 10 has a receiver or frame 12, a barrel 14, a slide 15, a firing mechanism 16, and a removable cartridge magazine 18. Referring also to FIG. 2, a schematic cross-sectional view of the pistol 10 is shown without the cartridge magazine. The frame 12 is preferably a one-piece member made of metal. However, the frame could be a multi-piece assembly including other materials such as plastic. The frame 12 has a handgrip section 20 with a cartridge magazine receiving area 22, a trigger guard section 24 and a slot 26 for the trigger assembly 28. The barrel 14 has a bottom rear lug 30. Referring also to FIGS. 2*a* and 2*b,* the lug 30 has a groove 32 and a rear bottom end 34 with a recess 36 on its right side. As seen in FIG. 2, a lug pin or take down pin 38 is connected to the frame 12 and extends through the groove 32. Because of the shape of the groove 32, the barrel 14 can move on the lug pin 38. The slide 15 is slidingly mounted to the top of the frame 12. A main portion of the barrel 14 is located in a main channel of the slide 15. The rear of the slide has a firing pin 40 therein. When the slide 15 is moved rearward on the frame 12, the barrel 14 is moved rearward by the slide 15. As the barrel 14 is moved rearward, interaction between the lug pin 38 and the groove 32 causes the rear of the barrel to move downward. In alternate embodiments other types of barrels and/or barrel mounting systems could be provided. The purpose of the recess 36 will be described below. However, in alternate embodiments, the recess could be on the left side of the lug or in an interior area of the lug. Any suitable type of slide could also be provided. In addition, any suitable type of firing pin or striker could be provided.

Figure 3:
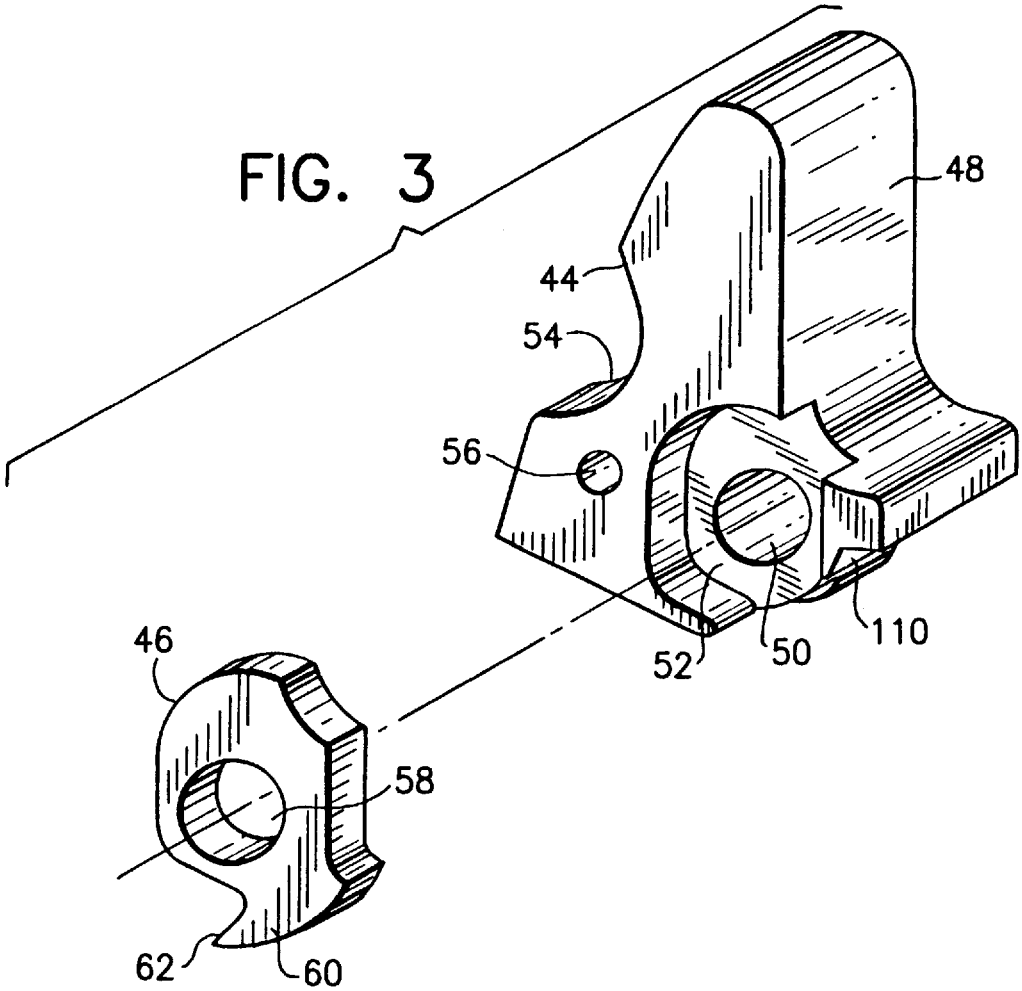
FIG. 3 is an exploded perspective view of the hammer assembly shown in FIG. 2.

The firing mechanism 16 includes the trigger assembly 28, the firing pin 40 and a hammer assembly 42. Referring also to FIG. 3, the hammer assembly 42 includes a first hammer member 44 and a second hammer member 46. The first hammer member 44 is made of metal, such as extruded, stamped or cast metal. The first hammer member 44 has a striking face 48, a mounting hole 50, a side pocket 52, a rear slot 54, and two rear holes 56 (only one of which is shown) on opposite sides of the rear slot 54. The second hammer member 46 is a plate made of metal. The plate 46 is preferably stamped from a hardened metal member. The plate 46 has a mounting hole 58 and a bottom projection 60 with a sear surface 62. The plate 46 is located in the side pocket 52 of the first member 44. The shapes of the pocket 52 and the portion of the plate 46 in the pocket interlock the two members together. The holes 50, 58 align with each other. A hammer pin 64 extends through the two holes 50, 58 to pivotably mount the hammer assembly 42 to the rear end of the frame 12. The projection 60 extends out of the pocket 52 and past the bottom end of the first hammer member 44. A strut pin 66 is mounted in the holes 56 and spans the rear slot 54. A hammer strut 68 extends into the slot 54. The strut 68 is spring loaded by a spring 70 against the strut pin 66. This biases the top of the hammer assembly 42 in a forward direction. In alternate embodiments other types of hammer assemblies could be provided. In addition, alternative or additional means could be provided to interlock the two hammer members together. When assembled, the right sides of the two members 44, 46 are flush with each other. The interlocking nature of the two members allows the plate 46 to rotate the first member 44 when the plate 46 is rotated on the hammer pin 64. Likewise, when the first hammer member 44 rotates on the hammer pin 64, the first hammer member 44 causes the plate 46 to rotate with it.

Figure 4:
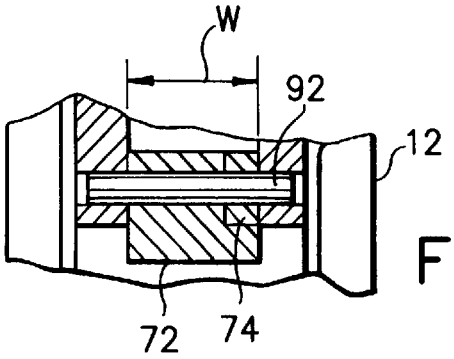
FIG. 4 is a cross-sectional view of the mounting of the trigger assembly taken along line 4—4 in FIG. 2.
Figure 5:
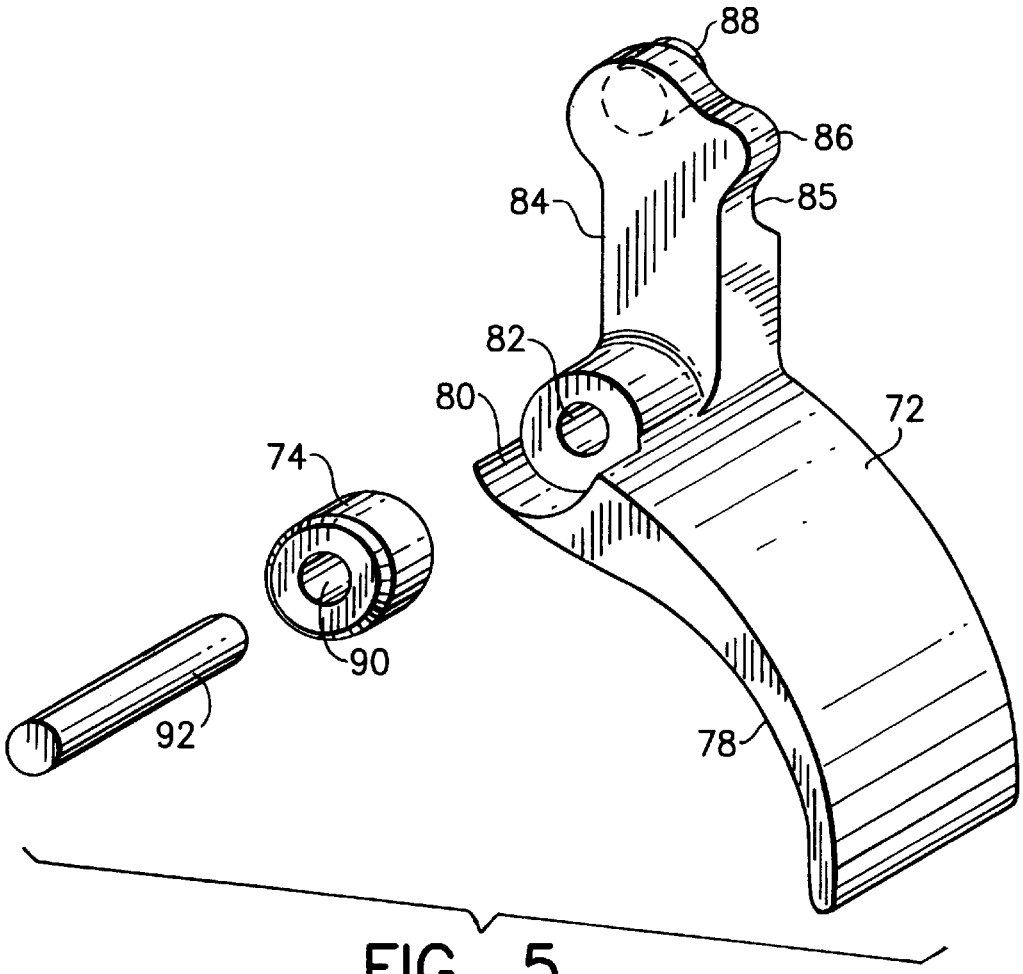
FIG. 5 is an exploded perspective view of the trigger assembly.

Referring to FIGS. 2, 4 and 5 the trigger assembly 28 generally comprises a trigger member 72, a trigger spacer 74 and a trigger pull bar 76. The trigger member 72 is preferably a one piece member. The trigger member 72 has a bottom finger contact section 78, a middle section with a spacer pocket 80 and a mounting hole 82, and a top section 84 with a stop 86 and a side projection 88. The width of the finger contact section 78 is about the same width of the slot 26 in the frame 12. The spacer 74 is located in the pocket 80. The spacer 74 has a mounting hole 90. The hole 90 is aligned with the hole 82. A trigger pin 92 extends through the two holes 82, 90. The pin 92 is connected to the frame 12 across the slot 26. This pivotably mounts the trigger member 72 and spacer 74 to the frame 12. As seen best in FIG. 4, the combination of the trigger member 72 and the spacer 74 span the width W of the slot 26. The top section 84 is relatively thin and extends from only a right side of the trigger member 72. The width of the top section 84 at the side projection 88 is about the same as the width of the recess 36 in the barrel lug 30 (see FIG. 2*a*). The trigger bar 76 has a front end with a hole that is pivotably mounted on the side projection 88. The width of the front end of the trigger bar 76 is about the same width as the side projection 88. The top section 84 of the trigger member 72 also has a recess 85 around the side projection 88 to accommodate the front end of the trigger bar 76. The rear end of the trigger bar 76 has an inwardly extending lateral projection 94 and a hole 96. A spring 98 is provided with one end connected to the frame 12 and an opposite end connected to the trigger bar 76 at the hole 96. The spring 98 biases the trigger bar 76 in a rearward direction. The rear projection 94, when the bar 76 is pulled forward is positioned to contact the projection 60 of the hammer plate 46 and pivot the hammer assembly 42 about the hammer pin 64.

Figure 6:
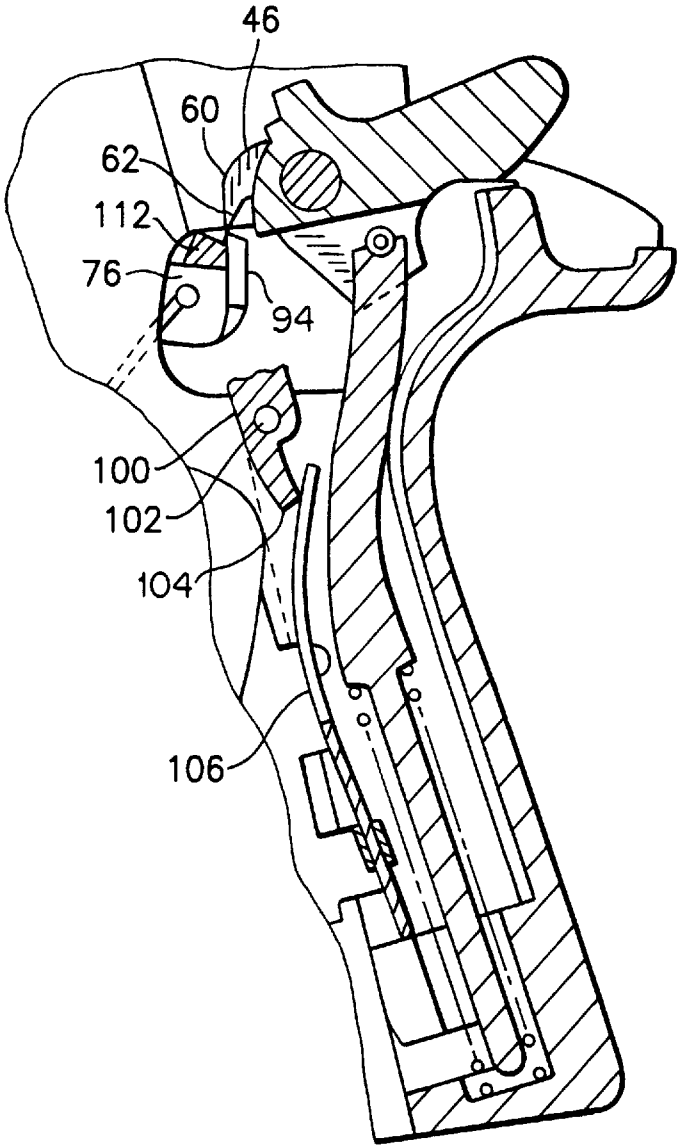
FIG. 6 is a partial cross-sectional view of the rear end of the pistol shown in FIG. 2 with the hammer moved to a location where the trigger bar is about to be pulled off of the hammer sear.
Figure 7:
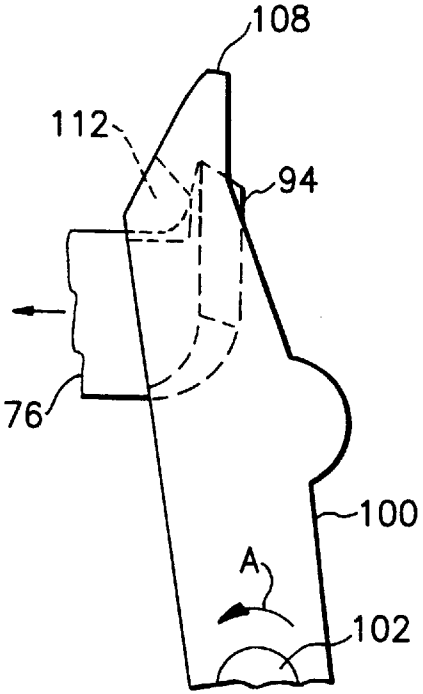
FIG. 7 is an enlarged view of components of the firing mechanism shown in FIG. 6.

FIG. 6 shows the bar 76 pulled forward to a point where the projection 94 is about to be pulled off of the sear surface 62 of the hammer plate 46. A safety sear 100 is pivotably mounted to the frame 12 by a sear pin 102. The bottom end 104 of the sear 100 is biased forward by a leaf spring 106. As seen best in FIG. 2, the top end 108 of the safety sear 100 is located to engage a stop surface 110 on the hammer assembly 42. Referring also to FIG. 7, the safety sear 100 has a side projection 112 facing the right side of the pistol. FIG. 7, similar to FIG. 6, shows the trigger bar 76 pulled forward to the point where the projection 94 is about to be pulled off of the sear surface 62. However, the projection 60 is not shown in this view for the sake of clarity. When the trigger bar 76 is pulled forward by a user moving the trigger assembly 28, the projection 94 is moved forward. The projection contacts the projection 60 and causes the hammer assembly 42 to rotate. If the trigger assembly 28 is released by the user before the projection 94 is pulled off of the projection 60 in a forward direction, the hammer assembly 42 is returned to its home position shown in FIG. 2 by the strut 68 and spring 70. The top end 108 of the safety sear 100 contacts the stop surface 110 to stop the striking surface 48 from hitting the rear end of the firing pin 40. If, on the other hand, the trigger assembly 28 is moved by a user through a full pull or stroke, just before the projection 94 is pulled off of the sear surface 62, the trigger bar projection 94 contacts the side projection 112 of the safety sear and moves it forward. This causes the safety sear 100 to rotate as indicated by arrow A. This moves the top end 108 of the safety sear 100 out of the path of the stop surface 110. Thus, when the projection 94 is pulled off of the sear surface 62, the hammer assembly 42 can pivot forward to strike the rear end of the firing pin 40 without the safety sear 100 stopping the full motion of the hammer assembly.

Mounted on the sear pin 102, with the safety sear 100, is an ejector (not shown). The ejector (not shown) also cooperates with a firing pin lock (not shown) under the rear sight 114 similar to the mechanism described in U.S. Pat. No. 4,021,955 which is hereby incorporated by reference in its entirety. The pistol 10 also has disconnect for the trigger bar 76 similar to that shown in U.S. Pat. No. 4,021,955. After the pistol 10 is fired, the slide 15 moves the disconnect (not shown) downward. The disconnect, in turn, moves the rear end of the trigger bar 76 downward. When the rear end of the trigger bar 76 in moved downward, the trigger bar 76 disengages from the side projection 112. The spring 106 biases the safety sear 100 back to its home position shown in FIG. 2 with the top end 108 of the safety sear 100 against the front bottom side of the hammer assembly 42. As the slide 15 returns to its battery position shown in FIG. 2, the safety sear 100 catches the hammer assembly 42 at the stop surface 110. Thus, the hammer assembly 42 is prevented from striking the firing pin 40 a second time.

One of the features of the pistol 10 is the two piece configuration of the hammer assembly 42. A pivoting hammer needs to have sufficient mass to properly propel a firing pin when struck and, have sufficient structure to be both properly mounted to the frame and properly connected to a propulsion spring. This is most efficiently and commonly accomplished by making the hammer from ordinary extruded or stamped metal. Such a metal member is relatively easy to machine to form the various holes and shaped surfaces. However, with the pistol 10, a very limited area of movement is provided on the right side of the safety sear 100 for the bottom projecting portion of the hammer to move. If the hammer was made as a single ordinary metal member, the bottom projection of the hammer could break with repeated use. The two piece hammer assembly 42 overcomes this problem. More specifically, the plate 46 can be made of hardened metal. Thus, even though the plate 41 is relatively thin, it is much stronger than the first hammer member 44 and will not break even with years of repeated use. The interlocking nature of the plate 46 in the pocket 52 means that the plate 46 is prevented from rotating relative to the first hammer member 44. They will rotate on the hammer pin 64 together. Thus, the first hammer member 44 can be relatively easily machined, the plate 46 can be sufficiently thin to move in the narrow space next to the safety sear 100, and the plate 46 is sufficiently strong to work without breaking.

The pistol 10 is a double action only pistol. In other words, the hammer assembly 42 cannot be locked in a cocked position. Double action only pistols are known, such as described in U.S. Pat. No. 5,050,480. However, it uses a trigger bar that pushes the striker. The pistol in U.S. Pat. No. 4,021,955 also uses a trigger bar that pushes. Trigger bars that pull are known, such as disclosed in U.S. Pat. No. 4,306,487. However, the design of a double action only pistol with a pulled trigger bar presented a problem because of the location of the barrel lug. As can be seen in FIGS. 1 and 2, with the barrel 14 in a horizontal position, the trigger pin 92 is located partially under or almost under the lug pin 38. The compact design of the pistol 10 presented the problem of not enough space to move the top section 84 of the trigger member 72 and the front of the trigger bar 76 in order to move the hammer 42 a sufficient angle of rotation. The pistol 10 is preferably small in length. Therefore, it is undesirable to move the barrel forward or move the trigger assembly rearward; both of which would require the pistol to be increased in length. Therefore, the recess 36 has been provided in the barrel lug 30. This recess 36 has been contoured to accommodate the top section 84 of the trigger member 72 and the front of the trigger bar 76; even when the top of the trigger member is forwarded and the rear of the barrel has been moved back and down by the slide 15 and the lug pin 38. The stop 39 on the frame 12 stops the trigger member 72 from being rotated too much that might otherwise cause the lug 30 to contact the top section 84 of the trigger member 72. Therefore, a compact pistol can be provided which is also a double action only pistol, and has a pulled trigger bar. The contour of the recess 36 is such to minimize reduction in strength of the lug 30. The configuration described above also eliminates the need to make the pistol wider.

As noted above, the trigger assembly 28 has a trigger member 72 and a spacer 74. Because of the relatively long length of the trigger member 72 from top to bottom, a problem was encountered when attempting to insert a similar trigger member, without the pocket 80, into the slot 26. In particular, the bottom tip of the finger contact section 78 would contact the trigger guard section 24 of the frame 12. This would prevent, or at least make difficult, insertion of the trigger member into the slot 26, through the bottom of the slot, during assembly. To overcome this problem, the trigger member 72 has been provided with the pocket or gap 80. The gap 80 allows the trigger member 72 to be inserted into the slot 26, through the bottom of the slot 26, with its bottom tip passing by the trigger guard section 24. Once the trigger member 72 is properly in the slot 26, the spacer 74 can be positioned in the pocket 80. The trigger pin 92 can then be used to pivotably mount the two members 72, 74 to the frame 12. Thus, a relatively long trigger member can be inserted into a trigger slot in a frame past a trigger guard. The two members 72, 74 occupy the width of the slot 26 such that the trigger member 72 does not significantly laterally slide on the pin 92. However, in alternate embodiments, other types of trigger assemblies could be provided.

Figure 8:
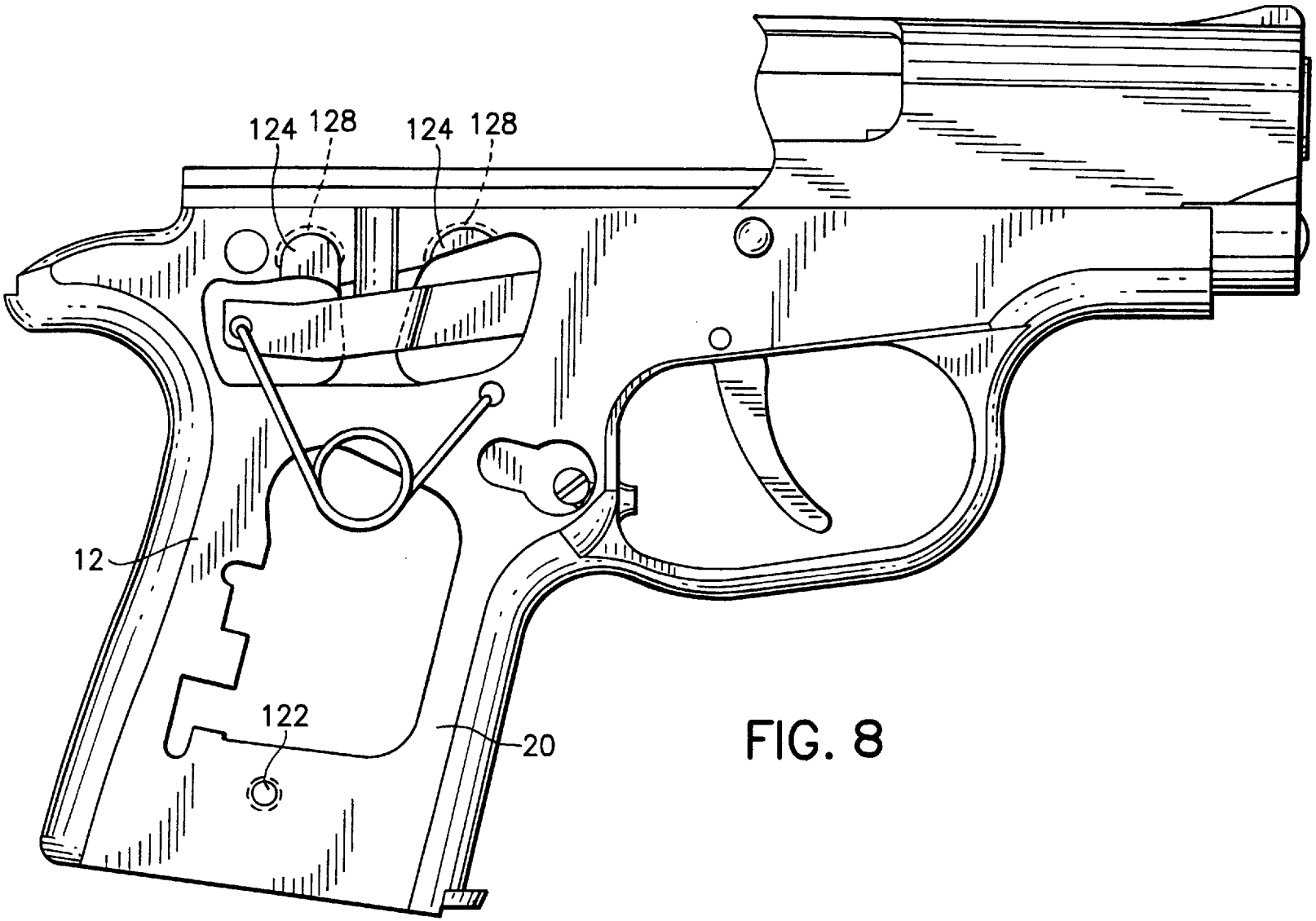
FIG. 8 is a partial side view of the pistol shown in FIG. 1 with the handgrip panels removed.
Figure 9:
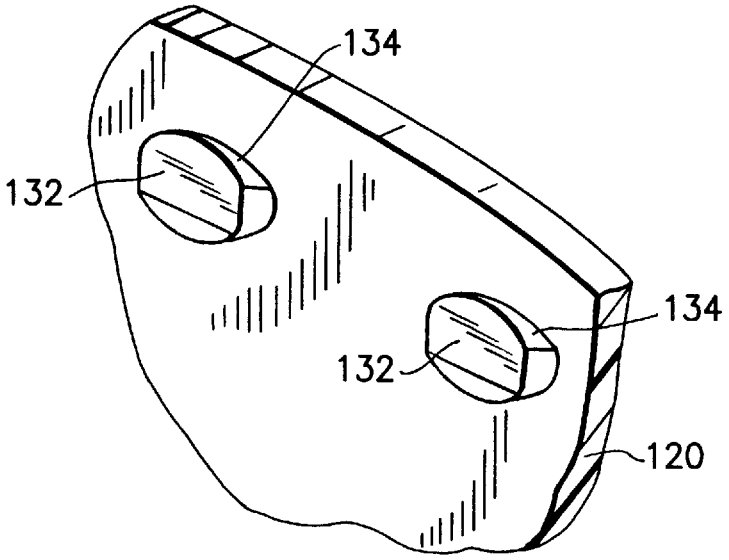
FIG. 9 is a partial perspective view of the top of the inner side of the right panel shown in FIG. 1.
Figure 10:
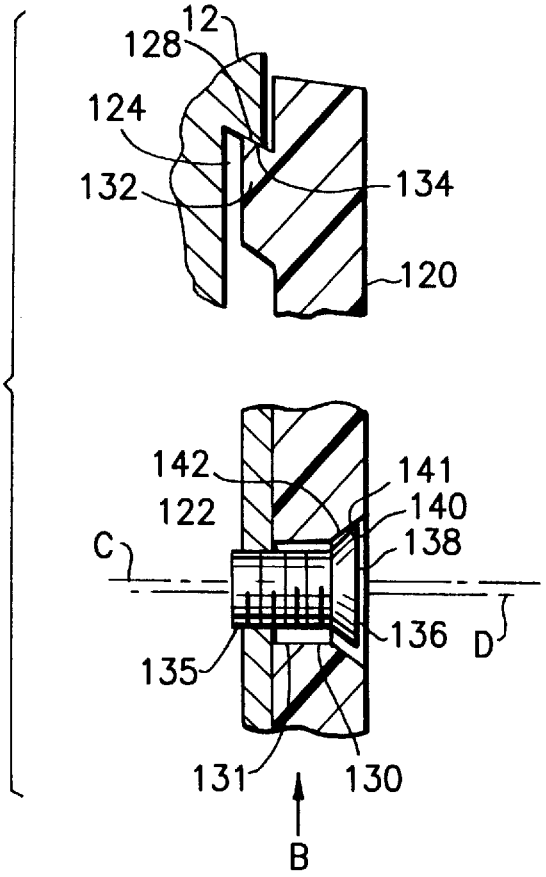
FIG. 10 is a schematic cross-sectional view of the connection of the right handgrip panel to the frame.

Referring now to FIGS. 1, 8 and 9, another feature of the pistol 10 will be described. The pistol 10 includes two handgrip panels 120 (only one of which is shown). The panels 120 are mounted to the frame 12 on opposite sides of the handgrip section 20. The handgrip section 20 has two threaded holes 122; one on each side. The holes 122 are both located at the bottom of the handgrip section. Located at the top of the right side of the handgrip section 20 are two slots 124. The slots 124 have angled top surfaces 128 (see FIG. 10). The right side panel 120 has a hole 130 in its bottom and, as seen in FIG. 10, two projections 132 on an inner side at the top of the panel 120. The projections 132 have angled top surfaces 134. Referring also to FIG. 10, the connection of the right panel 120 to the frame 12 will be described. The two projections 132 are inserted into the two slots 124. A fastener 136 is inserted into the hole 130 and screwed into the hole 122. The fastener 136 has a head 138 with an angled surface 140. The hole 130 has an angled surface 142 on its top side. The two holes 122 and 130 have center axes C and D that are slightly offset from each other. The axis D of the hole 130 is lower than the axis C of the hole 122. The narrow portion 131 of the hole 130 is also larger than the shaft section 135 of the fastener 136. As the fastener 136 is tightened, the two angled surfaces 140, 142 contact each other at area 141 and interact to move the panel 120 in an upward direction as indicated by arrow B. Prior to screwing the fastener 136 into the hole 122, the two projections 132 are located in the slots 124. As the panel 120 is moved upward when the fastener 136 is attached, the angled surfaces 128, 134 contact each other and pull the top of the panel 120 against the frame 12. The projections 132 are thus entrapped in the slots 124. The connection of the left side panel to the frame 12 is substantially similar, but the left side panel only has one top projection. With this type of connection, only one fastener is required for each panel. However, each panel is nonetheless fixedly secured to the frame at both its top and its bottom. In alternate embodiments, any suitable type of mounting system could be used. Alternatively, the handgrip section need not have panels, such as when the frame forms the complete sides of the handgrip section.

It should be understood that the foregoing description is only illustrative of the invention. Various alternatives and modifications can be devised by those skilled in the art without departing from the scope of the invention. Accordingly, the present invention is intended to embrace all such alternatives, modifications and variances which fall within the scope of the appended claims.

What is claimed:

1. In a firearm having a frame, a barrel connected to the frame, and a firing mechanism connected to the frame, the firing mechanism having a hammer pivotably mounted to the frame, wherein the improvement comprises:

the hammer having a first hammer member with a striking face and a second hammer member with a sear surface, the first hammer member having a pocket and the second hammer member comprising a plate that is located in the pocket of the first hammer member to stationarily interlock the two members to each other.

2. A firearm as in claim 1 wherein the pocket is located on a lateral side of the first hammer member.

3. A firearm as in claim 1 wherein the second hammer member is a flat plate made from sheet metal.

4. A firearm as in claim 3 wherein the first and second hammer members each have a hole with a pin extending through the holes to pivotably mount the two members to the frame.

5. In a firearm having a frame, a barrel connected to the frame, and a firing mechanism connected to the frame, the firing mechanism having a hammer pivotably mounted to the frame, wherein the improvement comprises:

the hammer having a sear member with a sear surface thereon, the sear member being connected to the hammer by a pin and wherein the hammer has a pocket and the sear member is located in the pocket to stationarily fix the sear member to the hammer so that the hammer and sear member always pivot as a unit without any relative movement therebetween.

* * * * *